US005095935A

United States Patent [19]

Blackley

[11] Patent Number: 5,095,935

[45] Date of Patent: Mar. 17, 1992

[54] PATCH FOR RUPTURED FLUID TANKS

[76] Inventor: Edward E. Blackley, 8915 - 78 Avenue, Edmonton, Alberta, Canada, T6C 0N7

[21] Appl. No.: 660,893

[22] Filed: Feb. 26, 1991

[30] Foreign Application Priority Data

Sep. 24, 1990 [CA] Canada ..... 2026019

[51] Int. Cl.[5] ..... F10L 55/168

[52] U.S. Cl. ..... 137/315; 138/99

[58] Field of Search ..... 137/315; 138/99; 114/227, 229; 220/228

[56] References Cited

U.S. PATENT DOCUMENTS

| | | | |
|---|---|---|---|
| 438,196 | 10/1880 | Smith . | |
| 645,070 | 3/1900 | Colomes . | |
| 1,122,047 | 12/1914 | Villiers . | |
| 1,221,496 | 4/1917 | Wullyamoz . | |
| 1,306,938 | 6/1919 | Achiha . | |
| 2,446,190 | 8/1948 | Oding | 114/227 |
| 2,492,507 | 12/1949 | Tipton | 138/99 |
| 3,669,055 | 6/1972 | Buce | 114/229 |
| 3,857,249 | 12/1974 | Kelly et al. | 61/68 |
| 4,175,510 | 11/1979 | Devine | 114/227 |
| 4,202,379 | 5/1980 | Velter | 138/99 |
| 4,569,303 | 2/1986 | McDuff et al. | 114/227 |
| 4,712,502 | 12/1987 | McDuff | 114/229 |

*Primary Examiner*—Alan Cohan

*Attorney, Agent, or Firm*—Beveridge, DeGrandi & Weilacher

[57] ABSTRACT

A Patch for Ruptured Fluid Tanks consisting of a container having an opening a peripheral edge. A rupture in a fluid tank is enclosed within the peripheral edge of the opening. A fluid filled tubular seal is provided along the peripheral edge of the opening. The tubular seal compresses to bring the opening of the container enclosing the rupture into sealing engagement with the fluid tank. A fluid bypass passage is provided through the container. Fluids escaping through the rupture flow through the bypass while the container is being placed over the rupture. The container is secured by cables to a fluid tank. The bypass passage is remotely closed to contain fluids escaping through the rupture within the container once the container has been secured to the fluid tank.

3 Claims, 2 Drawing Sheets

PATCH FOR RUPTURED FLUID TANKS

The present invention relates to a patch for ruptured fluid tanks.

BACKGROUND OF THE INVENTION

There are an enormous variety of fluids used in our society, many of them toxic. Every day these fluids are transported by truck or rail through our cities. Accidents occur with alarming regularity, many of which result in a rupturing of the fluid tanks.

The procedure followed when there is a ruptured tank is to rush an alternate tank to the scene and transfer the fluids to the alternate tank. This procedure is not always practical. A transfer of fluids takes time, and when toxic substances are being released into the atmosphere in a heavily populated area human lives are placed at risk. Placing a patch over the rupture in the fluid tank is rarely considered a viable option, as fluids escaping from the rupture tend to impede or prevent the placement of the patch.

SUMMARY OF THE INVENTION

What is required is a patch for ruptured fluid tanks which can be placed over the rupture irregardless of escaping fluids.

According to the present invention there is provided a Patch for Ruptured Fluid Tanks which is comprised of a container having an opening with a peripheral edge. A rupture in a fluid tank is enclosed within the peripheral edge of the opening. A fluid filled tubular seal is provided along the peripheral edge of the opening. The tubular seal compresses to bring the opening of the container enclosing the rupture into sealing engagement with the fluid tank. A fluid bypass passage is provided through the container. Fluids escaping through the rupture flow through the bypass while the container is being placed over the rupture. Means for securing the container to a fluid tank are provided. Means for remotely closing the bypass passage are provided to contain fluids escaping through the rupture within the container once the container has been secured to the fluid tank.

With the described invention fluids escaping under pressure from a rupture in a fluid tank are diverted through the bypass passage. As long as the escaping fluids can continue to flow through the container at substantially the same rate as they are flowing through the rupture, little difficulty is encountered in positioning the container. Once the container is in position it can be secured against movement. The bypass passage is then remotely closed confining the escaping fluids within the container. The tubular seal prevents the escape of fluids between the peripheral edge of the opening in the container and the fluid tank.

The applicant prefers to secure the container in position using a cable with attached "come along" for tensioning the cable. In order to facilitate this means of securing container to a fluid tank the container has an exterior surface with a plurality of protruding eyelets. Cables are extended through the eyelets.

The applicant prefers to use a "flapper" type of valve as the means for remotely closing the bypass passage. The fluids escaping through the rupture in the tank close the valve and maintain the valve secured in a closed position. The flapper valve is held in the open position by a pivotally mounted catch. A triggering wire is provided having one end secured to the catch and a remote end. Upon pulling of the remote end of the triggering wire the catch pivots thereby releasing the flapper valve which is forced into a closed position by pressure exerted by fluids escaping through the rupture.

Although beneficial results may be obtained through the use of the Patch for a Ruptured Fluid Tank as described, large patches intended for large ruptures unavoidably are heavy and consequently difficult to handle. Even more beneficial results may therefore be obtain when the container has wheels whereby the container moves along the surface of a fluid tank. The wheels are spring mounted such that when the container is positioned over the rupture the springs are compressed by the means for securing the container to a fluid tank.

Although beneficial results may be obtained through the use of the patch for a ruptured fluid tank as described; when an accident occurs involving a transport vehicle upon which a fluid tank is mounted, the valves controlling the ingress and egress of fluids from the tank are often inaccessible. Even more beneficial results may therefore be obtained by having a secondary passage with a control valve on the container. Fluids may be drawn from the fluid tank through the secondary passage or neutralizing chemicals introduced into the fluid tank through the secondary passage.

Although beneficial results may be obtained through the use of a patch for a ruptured fluid tank as described; the performance of the tubular seal is effected by the type of fluid used. If a gas is used as the fluid in the tubular seal, the seal can be subject to "chattering". This chattering is a vibrating of the edge of the seal which permits the escape of fluids from the container. If water is used as the fluid in the tubular seal, its performance is effected by extremes in temperature. Even more beneficial results may therefore be obtained when the fluid in the fluid filled tubular seal is antifreeze.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
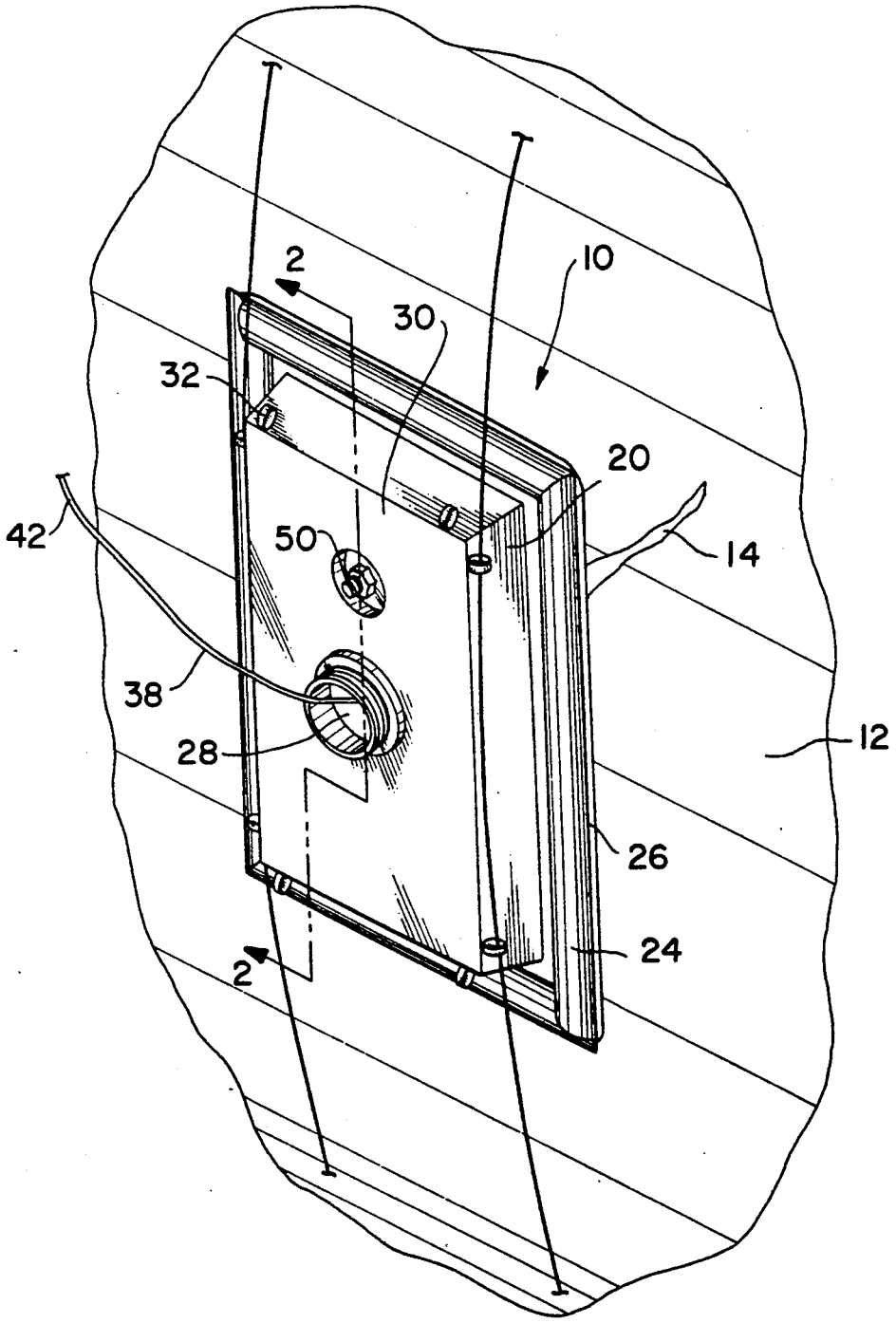
FIG. 1 is a perspective view of a patch for a ruptured fluid tank constructed in accordance with the teachings of the present invention.
Figure 2:
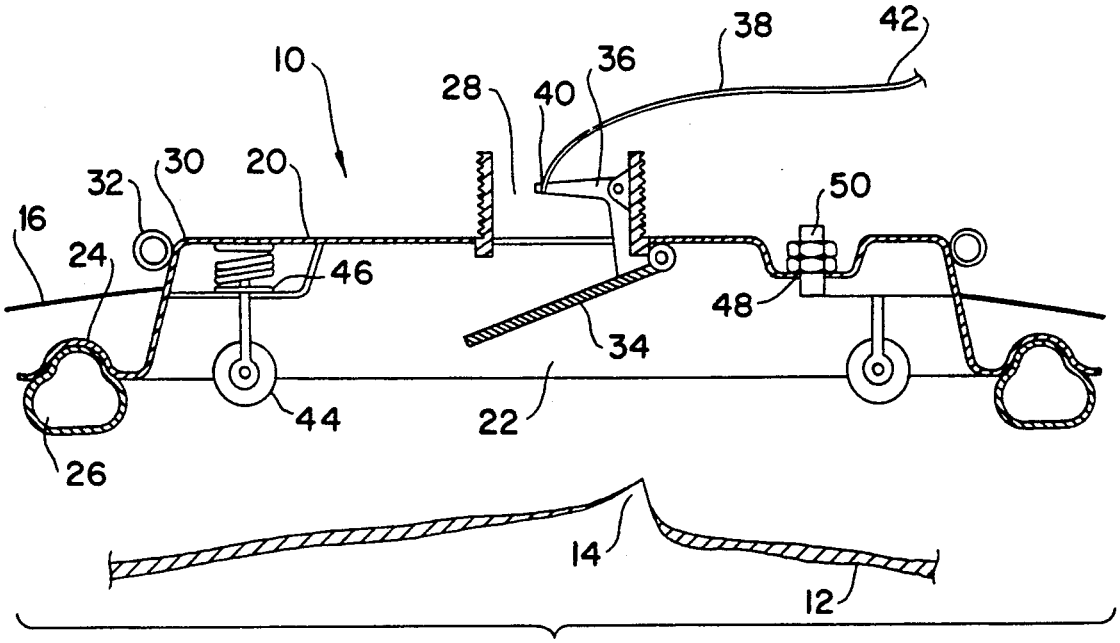
FIG. 2 is a section view taken along section lines 2—2 of FIG. 1.
Figure 3:
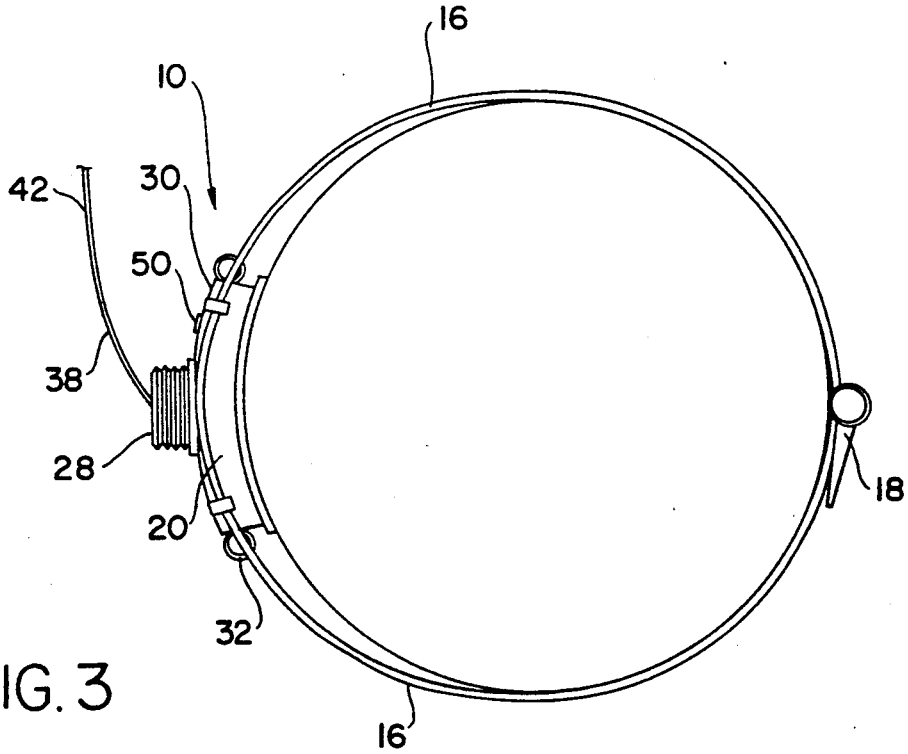
FIG. 3 is a top plan view of the patch for a ruptured fluid tank illustrated in FIG. 1, secured by cables to a fluid tank.

The present invention, a patch for a ruptured fluid tank generally identified by reference numeral 10, will now be described with reference to FIGS. 1 through 3. For the purpose of this description, some elements will be described which are encountered during use but do not directly form part of the invention. A fluid tank will be identified by reference numeral 12. A rupture in the fluid tank will be identified by refeence numeral 14. A cable will be identified by reference numeral 16. A winch or "come along" secured to cable 16 will be identified by reference numeral 18.

Patch 10 is a container 20 having an opening 22 with a peripheral edge 24. A fluid filled tubular seal 26 is provided along peripheral edge 24 of opening 22. A fluid bypass passage 28 is provided through container 20. In order to facilitate securing container to fluid tank 12 by means of cables 16, container 20 has an exterior surface 30 with a plurality of protruding eyelets 32. A "flapper" type of valve 34 is used as the means for remotely closing bypass passage 28. Flapper valve 34 is held in the open position by a pivotally mounted catch 36. A triggering wire 38 is provided having one end 40 secured to catch 36 and a remote end 42. Container 20 has wheels 44. Wheels 44 are mounted on springs 46. Container 20 also has a secondary passage 48 with a control valve 50.

The use and operation of patch 10 will now be described with reference to FIG. 1 through 3. When an emergency worker comes on the scene he take note that fluid tank 12 has a rupture 14. Container 20 is then loosely positioned on fluid tank 12 by means of cables 16 and come along 18, as illustrated in FIG. 3. Cables 16 extend through eyelets 32 on container 20. This permits container 20 to be suspended by cables 16 and yet slidable toward rupture 14. Wheels 44 reduce resistance and facilitate movement of container 20 along fluid tank 12 until opening 22 is positioned over rupture 14. It is preferable that wheels 44 be capable of omni-directional movement, in order to provide increased manoeverability of patch 10. The Applicant, therefore uses swiveling castor wheels. The force of escaping fluids would normally make it impossible to position container 12 over rupture 14. For this reason container 20 has a fluid bypass passage 28 which permits the unrestricted flow of fluids through container 20. Come along 18 is then used to tighten cables 16, thereby drawing peripheral edge 24 of opening 22 tightly against fluid tank 12. As cables 16 are tightened springs 46 compress causing wheels 44 to retract within container 20. Opening 22 is of such a size that rupture 14 is enclosed within peripheral edge 24. As cables 16 draw container 20 tightly against fluid tank 12, tubular seal 26 compresses to bring peripheral edge 24 of opening 22 into sealing engagement with fluid tank 12. Once container 20 is securely positioned against fluid tank 12, flapper valve 34 is triggered by pulling upon remote end 42 of triggering wire 38. Triggering wire 38 pivots catch 36 thereby releasing flapper valve 34 which is forced into a closed position by pressure exerted by fluids escaping through rupture 14.

When valves (not shown) on fluid tank 12 controlling the ingress and egress of fluids are inaccessible, secondary passage 48 of container 20 is used to drawn fluids from or introduce neutralizing chemicals into fluid tank 12. These operations can be controlled using control valve 50.

The Applicant prefers to fill tubular seal 26 with antifreeze, as the performance of tubular seal 26 is effected by the type of fluid used. Gas can be subject to "chattering". This chattering is a vibrating of the edge of the seal which permits the escape of fluids from container 20. For this reason it is preferable if tubular seal is filled with a liquid. Some liquids, such as water, are effected by extremes in temperature; anti-freeze is free from such problems.

It will be apparent to one skilled in the art that in placing patch 10 over rupture 14 in fluid tank 12, that the performance of patch 10 is not adversely effected by the force exerted by escaping fluids, whether liquid or gas. It will also be apparent to one skilled in the art that, if a patch 10 is not of sufficient size to cover the entire length of a rupture, a number of patches 10 placed side by side will perform an adequate job. It will finally be apparent to one skilled in the art that modifications may be made to the preferred embodiment illustrated without departing from the spirit and scope of the invention as defined by the claims.

The embodiments of the invention in which an exclusive property or privilege is claimed are defined as follows:

1. A patch for ruptured fluid tanks, comprising:

a. a container having an opening with a peripheral edge, such that a rupture in a fluid tank is enclosed within the peripheral edge of the opening;

b. a fluid filled tubular seal along the peripheral edge of the opening, such that the tubular seal compresses to bring the opening of the container enclosing the rupture into sealing engagement with the fluid tank;

c. a fluid bypass passage through the container, such that fluids escaping through the rupture flow through the bypass while the container is being placed over the rupture;

d. means for securing the container to a fluid tank; and e. means for remotely closing the bypass passage to contain fluids escaping through the rupture within the container once the container has been secured to the fluid tank, the means for remotely closing the bypass passage including a flapper valve held in the open position by a pivotally mounted catch, a triggering wire being provided having one end secured to the catch and a remote end such that upon pulling of the remote end of the triggering wire the catch pivots thereby releasing the flapper valve which is forced into a closed position by pressure exerted upon the flapper valve by fluids escaping through the rupture.

2. A patch for ruptured fluid tanks, comprising:

a. a container having an opening with a peripheral edge, such that a rupture in a fluid tank is enclosed within the peripheral edge of the opening;

b. a fluid filled tubular seal along the peripheral edge of the opening, such that the tubular seal compresses to bring the opening of the container enclosing the rupture into sealing engagement with the fluid tank;

c. a fluid bypass passage through the container, such that fluids escaping through the rupture flow through the bypass while the container is being placed over the rupture;

d. means for securing the container to a fluid tank; and e. means for remotely closing the bypass passage to contain fluids escaping through the rupture within the container once the container has been secured to the fluid tank, f. the container having wheels whereby the container moves along the surface of a fluid tank, the wheels being spring mounted such that when the container is positioned over the rupture the springs are compressed by the means for securing the container to a fluid tank.

3. A Patch for Ruptured Fluid Tanks, comprising:

a. a container having an opening with a peripheral edge, such that a rupture in a fluid tank is enclosed within the peripheral edge of the opening;

b. a fluid filled tubular seal along the peripheral edge of the opening, such that the tubular seal compresses to bring the opening of the container enclosing the rupture into sealing engagement with the fluid tank;

c. a fluid bypass passage through the container, such that fluids escaping through the rupture flow through the bypass while the container is being placed over the rupture;

d. means for securing the container to a fluid tank;

e. means for remotely closing the bypass passage to contain fluids escaping through the rupture within the container once the container has been secured to the fluid tank, and f. the fluid in the fluid filled tubular seal being anti-freeze.

* * * * *